United States Patent [19]

Iams et al.

[11] Patent Number: 4,674,740

[45] Date of Patent: Jun. 23, 1987

[54] EXERCISE MACHINE FOR SIMULATING SWIMMING MOTIONS

[75] Inventors: John F. Iams, Poway; Robson L. Splane, Jr., Granada Hills, both of Calif.

[73] Assignee: Superspine, Inc., Poway, Calif.

[21] Appl. No.: 743,481

[22] Filed: Jun. 11, 1985

[51] Int. Cl.[4] ..... A63B 31/00

[52] U.S. Cl. ..... 272/71; 128/25 R; 272/130; 5/62

[58] Field of Search ..... 272/71, 144, 146, 130, 272/97; 5/62, 101, 105, 106, 107; 128/71, 25 R; 434/254

[56] References Cited

U.S. PATENT DOCUMENTS

| | | | |
|---|---|---|---|
| 1,966,448 | 7/1934 | Kabisius | 272/71 |
| 1,990,124 | 2/1935 | Kabisius | 272/71 |
| 2,019,224 | 10/1935 | Hess | 272/71 |
| 2,497,391 | 2/1950 | Becker | 272/71 |
| 3,074,716 | 1/1963 | Mitchel et al. | 272/71 |
| 3,124,815 | 3/1964 | Harvey | 272/71 |
| 3,876,198 | 4/1975 | Seligman | 128/25 R |
| 4,146,222 | 3/1979 | Hribar | 272/130 |
| 4,422,634 | 12/1983 | Hopkins | 272/71 |

FOREIGN PATENT DOCUMENTS

| | | | |
|---|---|---|---|
| 629365 | 3/1963 | Belgium | 272/71 |

*Primary Examiner*—Richard J. Apley
*Assistant Examiner*—S. R. Crow
*Attorney, Agent, or Firm*—James W. McClain; Stanley A. Becker

[57] ABSTRACT

A swimming simulation exercise device is described. The device comprises a frame supporting a platform on which the user rests, arm cranks for simulating swimming stroke motions and resistance means for the user's legs to allow the user to simulate a kicking motion. The platform is preferably mounted on a gimballing apparatus which allows the user to simulate the normal rocking motion inherent in swimming. The apparatus incorporates means for providing a "simulated water line" effect such that the user encounters resistance to arm strokes during the lower half of the stroke (in which the arm would normally be in the water during swimming) and little or no resistance on the upper half of the stroke. Accessory devices such as heart rate monitors, lap/distance counters and the like can be attached to the device.

14 Claims, 11 Drawing Figures

FIG. 8
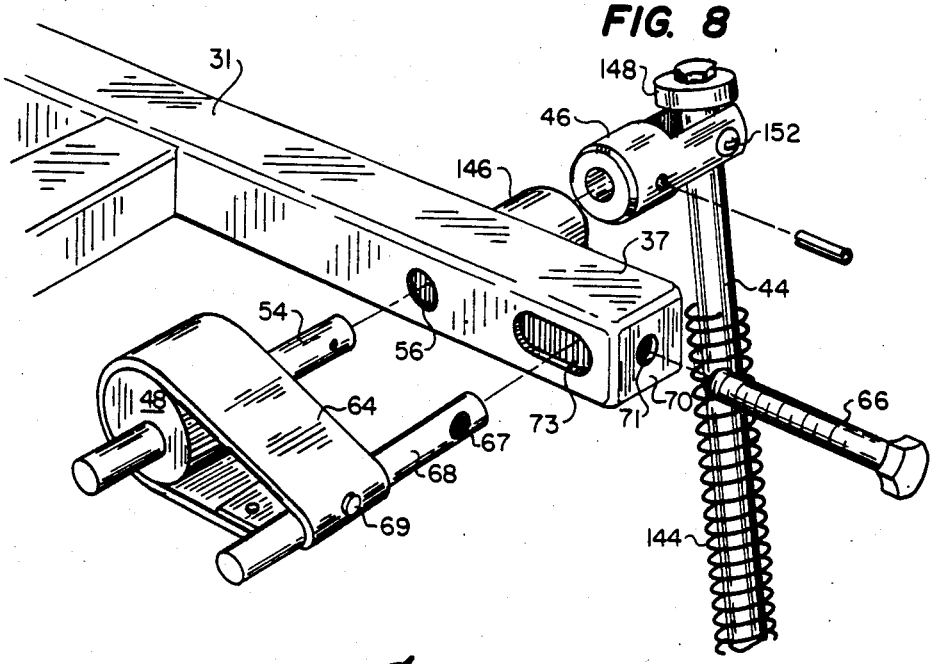
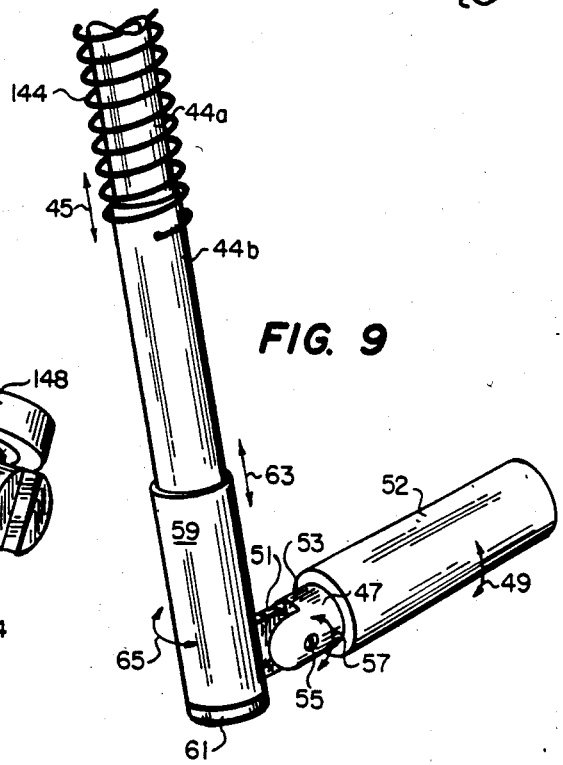
FIG. 9
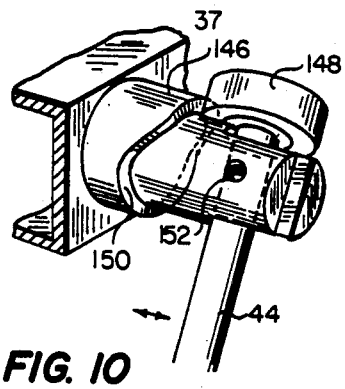
FIG. 10

EXERCISE MACHINE FOR SIMULATING SWIMMING MOTIONS

FIELD OF THE INVENTION

The invention herein relates to machines which provide human exercise, sports training and physical conditioning. More particularly, it relates to machines which allow the users to simulate swimming, notably the crawl and butterfly strokes.

BACKGROUND OF THE INVENTION

It has long been recognized that swimming is an excellent form of exercise. Swimming develops good muscle conditioning, is generally beneficial to the swimmer's spine and related bones and muscles, stimulates the cardiovascular system and is one of the most effective exercises for burning excess calories and weight reduction. Movement in water (non-weight bearing exercise) is the most beneficial form of exercise for people with arthritis and pain associated with loading of the spine and lower limbs, and is frequently prescribed by physicians for patients with such conditions.

However, it is difficult for most people to engage in swimming on a regular basis. One must normally have ready access to a swimming pool or natural body of water such as an ocean or lake. In many parts of the country outdoor pools and natural bodies of water are not usable for swimming during much of the year and public pools and beaches are usually crowded during swimming season. Public indoor pools usually have only limited time periods available for exercise swimming and private exercise clubs with pools are expensive to belong to. Finally, except for the person fortunate enough to be able to afford the expense and upkeep of his or her own backyard swimming pool, all others who desire to swim on a regular basis for exercise and physical conditioning must travel to the swimming facility.

It would, therefore, be most advantageous to have available a relatively compact piece of apparatus which could be used be a person at home or at a physical fitness facility, which apparatus would allow the user to simulate the beneficial exercise aspects of swimming at any time of his or her own choosing, without the need for a pool or other body of water and without concern for weather conditions, pool schedules or travel.

There have been attempts in the past to construct machines to simulate swimming. None of these have been properly designed or successful from the kinesthetic point of view, and many have been more harmful than beneficial. Further, some have been designed so that the user remains passive and his limbs are simply moved through the swimming-like motions with no significant effort on his part. Typical of the devices which have appeared in the past are those illustrated in U.S. Pat. Nos. 1,176,365 (a device with a windmill-type crank which simultaneously forces motion of the legs while the user lies on a substantially stationary platform); 1,966,448 (a similar device which includes a mechanism to force the user's head to pivot from side to side in synchronization with arm strokes); and 2,013,520 (a passive device in which motors force the user's arms to travel in an elliptical pattern and the legs to reciprocate). Also of interest is U.S. Pat. No. 2,019,224 which provides a fixed track and sprocket mechanism which force the user's arms to follow a path in which the arms alternate in providing the primary driving force for the apparatus.

It will be evident that none of these prior art devices provides means to enable a user to go through true swimming motions on his own and to provide the corresponding resistances and reciprocal motions which one encounters while actually swimming in water. Consequently, while the user of the prior art devices may project an appearance of swimming, he is not in fact obtaining the beneficial physical conditioning inherent in true swimming nor perceiving a simulated swimming kinesthetic experience.

BRIEF SUMMARY OF THE INVENTION

The invention herein is of an apparatus designed to provide a user with all of the beneficial effects of swimming while avoiding the harmful motions. The apparatus is compact, portable and readily usable in a person's home, a health club or other exercise facility.

In its broadest aspects, the present apparatus to enable a user to simulate the beneficial motions of swimming comprises:

a. a platform to support the user's trunk in a generally horizontal position;

b. means to support the platform which extends downwardly therefrom to the floor upon which the apparatus rests, to elevate the platform to a level above the floor at which the floor will not interfere with the user's movements while using the apparatus;

c. a pair of arm cranks, one mounted on either side of the axial center line of the platform, which when grasped by the user allow the user's arms to be moved through the full arm rotation movements of swimming;

d. selective resistance means operably attached to each of the arm cranks to provide significant resistance to the user's rotational movements of each arm when the arm is at or below the horizontal plane of the user's trunk and to minimize the resistance when the arm is above said plane; and e. support means attached to the inferior end of the platform to support the user's thighs and to permit limited motion of the thighs in a flutter kick movement.

In a preferred embodiment, the apparatus also comprises gimballing means attached to the platform to permit limited axial rotational motion of the user's trunk in response to the user's arm motions. The means for supporting the platform is preferentially a frame.

In some embodiments the apparatus can be made to fold or disassemble for compact storage and transportation. It can be equipped with timers, lap counters and distance computers or devices such as heart rate monitors can be attached.

Preferably, the selective resistance means comprises a cam-and-belt mechanism in which the cam frictionally engages the belt during that portion of the user's arm travel in which, during a swimming stroke, the user's arm would be in the water. This concept will often be referred to in this application as the "simulated water line" concept or effect.

BRIEF DESCRIPTION OF THE DRAWINGS

FIG. 8 is an exploded view of a cam-and-belt mechanism used to provide the selective resistance.

FIG. 9 is a view of a portion of the hand crank mechanism illustrating the various degrees of motion.

FIG. 10 is a perspective view of the arm crank cam.

BEST MODES OF THE INVENTION

The invention is best illustrated by reference to the appended drawings. It will be understood, of course, that the drawings and descriptions herein are based only on the embodiment shown, and that (as will be described) there are numerous additional embodiments not illustrated which are clearly within the scope and spirit of the present invention.

Figure 1:
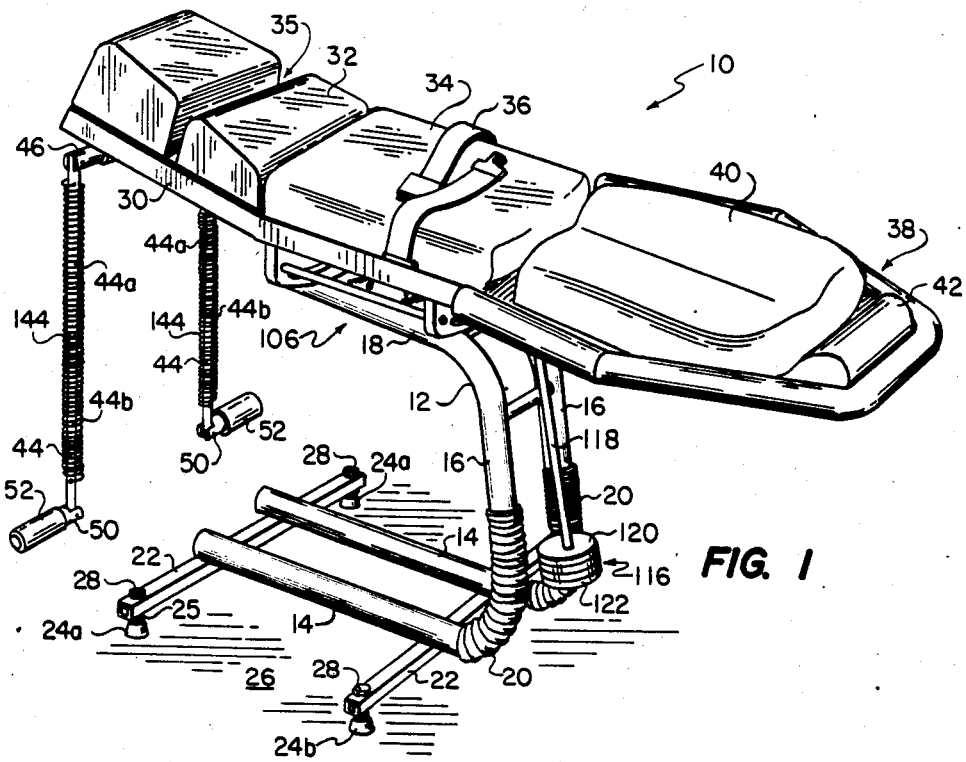
FIG. 1 is an overall perspective view of one embodiment of the apparatus of this invention.
Figure 2:
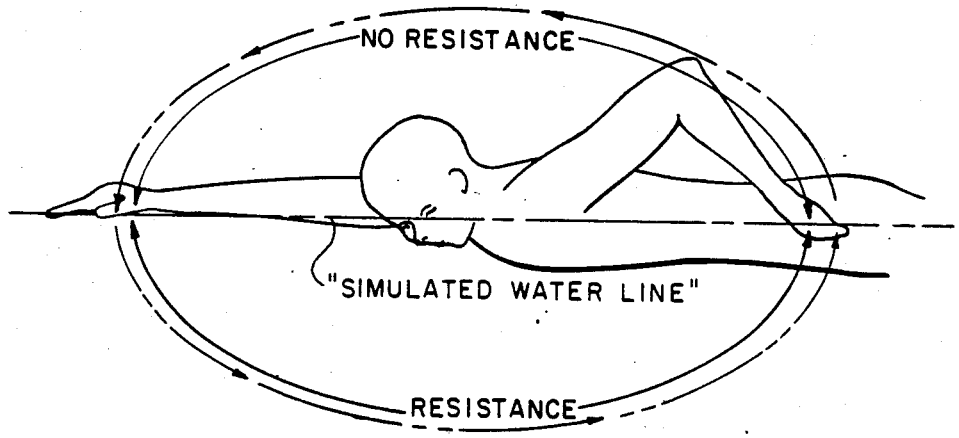
FIG. 2 is a schematic representation of the simulated water line concept.
Figure 3:
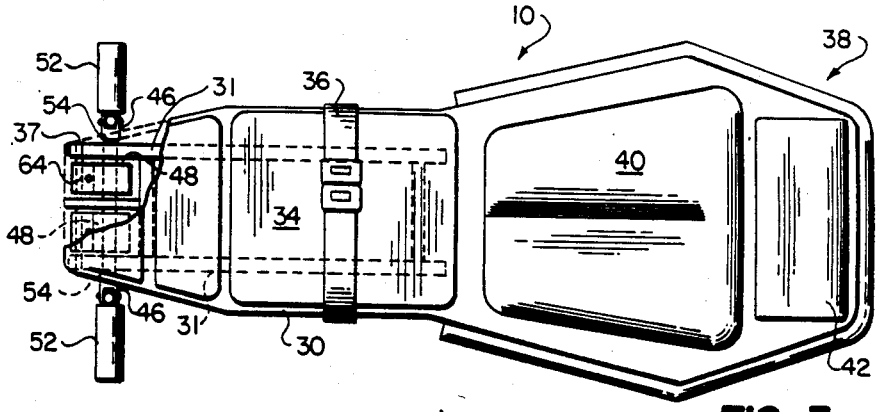
FIG. 3 is a plan view, partially cut-away, of the device of FIG. 1.

Considering first FIG. 1, the apparatus generally is designated as 10. It is supported by frame 12 which is composed of base members 14, vertical members 16 and top members 18. In the embodiment shown, each side of the frame consisting of members 14, 16 and 18 is a unitary curved tubular structure with the members each representing a segment of the single tube. The members may be individual, however, and link together at their joints by conventional fastening means which, as noted below, will allow the structure to be disassembled or folded. Alternately, members 16 may comprise two telescoping units which allow the entire apparatus to be raised or lowered. The apparatus can be fixed at any predetermined position by means such as pins inserted through corresponding holes in the two telescoping halves of member 16. Pairs of mating holes are spaced at intervals along the telescoping members to provide for differences in height of the apparatus.

The frame 12 may if desired be replaced by other types of support means. For instance, the platform 30 may be supported in a manner as simple as just resting on saw horses. However, a regular frame as frame 12 in the drawings is of course preferred, and the remainder of the description will be with reference to such a frame.

In the embodiment shown, bellows 20 are placed over the frame members for appearance purposes. The lower portion of the frame 12 is supported on cross members 22 from which depend feet 24*a* and 24*b* which rest on the floor 26. If desired, any of the feet 24 can be replaced by casters or wheels to allow the apparatus 10 to be more readily moved around a room. In a typical embodiment, the rear feet 24*b* are replaced by casters. This permits the apparatus to be easily moved by simply tilting back on the casters and raising feet 24*a* off the floor. When the apparatus is thereafter set back down in position with feet 24*a* on the floor 26, the apparatus stays properly in position. If casters or wheels are to replace all feet 24*a* and 24*b*, they should be a locking type so that once the apparatus 10 is positioned where desired, it can be used without having the apparatus move while the user is exercising. Alternatively, conventional means can be used to have wheels or casters which raise or lower, or feet 24 which raise and lower, to allow the wheels and feet to engage floor 26 alternately. In the embodiment shown in FIG. 1, bolts 28 are used to adjust the heights of individual feet 24 so that the device can sit level on the floor 26.

It is also desirable to incorporate springs 25 on the front feet 24*a* (or front casters) to serve as shock absorbers. This permits the entire apparatus to "bob" slightly in response to the user's swimming motion.

Mounted above the frame 12 is platform 30, which is attached to the frame 12 through gimballing mechanism 106. Platform 30 may be a simple flat board but preferably is underlaid by a supporting underframe 31 secured to the underside thereof. As will be noted below, underframe 31 also supports the selective resistance mechanism used to provide the artificial water line effect. Platform 30 is padded with by cushions 32 and 34 and is the support upon which the user lies. The structure is proportioned such that the upper portion of the user's trunk rests on cushion 32 and the lower portion of the user's trunk rests on cushion 34. A belt 36 may be provided for the user to buckle around the back part of his waist while he lies prone on the device.

If desired, the platform 30 and underframe 31 can be made in two more pieces with overlapping or telescoping sections such that the support 30 can be extended both laterally and axially to accommodate both large and small persons as users. Also, the space 35 between cushions 32 and 34 can be expanded and the cushions positioned such that the space 35 provides accommodation for breasts of female users.

The platform 30 may be extended by inferior portion 38 which supports the user's thighs on cushion 40. Cushion 42 is positioned to support the user's knees and/or lower legs; such support prevents hyperextension of the user's knees.

Platform 30 is generally horizontal although it may slope slightly downwardly toward the inferior (foot) end. It is normally aligned such that the position of the user's body is approximately the position that would be assumed by the user when swimming the crawl or butterfly stroke in water. However, means maybe attached preferably through the frame 12 to allow the platform to be tilted at a greater angle to facilitate the user getting on or off of the apparatus. For instance, a pivot joint could be placed at point 21 at the junction of each vertical member 16 and top member 18 to allow the unit to be pivoted upwardly at that location. This pivoting could be assisted by a hydraulic or pneumatic piston and cylinder system attached at opposite ends to the lower portion of the frame 12 and the underside of the platform 30. Other devices could be used in place of the piston and cylinder mechanism, such as a jack screw mechanism (with a steep pitch) or a worm screw raising and lowering a pantographic apparatus.

Located at the underside of the superior (head) end of platform 30 is the mechanism which provides for the selective resistance effect and arm strokes of the user. As will be discussed in detail below, the mechanism is preferably supported by extensions 37 of underframe 31.

Since the mechanisms are identical except for being right and left handed, only a single one of the pair will be described, starting with arm crank 44. The crank 44 is attached through a universal joint 46 and shaft 54 to cam 48, the shaft 54 being being journalled in hole 56 in extension 37. Arm crank 44 terminates at its outward end in multi-motion apparatus 50 to which is attached handgrip 52. Arm crank 44 is constructed of two or more telescoping sections 44*a* and 44*b*. The telescoping feature allows the arm crank's length to vary as the user moves his arms in the normal swimming motion. Thus, the normal arm strokes of swimming can be properly simulated, rather than having the user's arms artificially forced to maintain a fixed extension in the manner of many prior art devices. Retraction of the arm crank 44 is assisted by tension spring 144 secured at its ends to the two sections of crank 44.

The hand grips 42 can be as shown in the form of rotatable rods which are actually gripped by the user. Alternatively, the hand grips 52 could be in the form of flat pads on which the user lays his hands to give more of the simulation of the extended hand position common to swimming. A strap or similar restraining device would secure the user's hand to the "paddle-type" hand grips 52. In an alternative but less preferred embodiment the hand grip 52 could be in the form of a glove or mitten in which the user places his hands.

The details of the different degrees of motion available for the user's arms in apparatus 50 are shown in FIG. 9. The telescoping relationship of arm cranks section 44*a* and 44*b* allow for extension and retraction of the arm crank 44 as indicated by arrow 45. Handgrip 52 is rotatably mounted on shaft 47 providing for rotational motion as indicated by arrow 49. The inward end of shaft 47 terminates in a swivel joint formed by tongue 51 being fitted in slot 53 and pinned by bolt 55, thus permitting the swivel motion indicated by arrow 57. Tongue 51 in turn is fixed to sleeve 59 which is slidably mounted on arm crank section 44*b* and is restrained at the outward end by stop 61. Sleeve 59 provides for sliding motion indicated by arrow 63 and rotational motion as indicated by arrow 65.

This multi-dimensional freedom of motion imparted by this apparatus 50 allows the user to simulate the proper of motion of swimming. Not only do the user's arms move at the shoulder correctly and extend and retract at the appropriate points in the stroke, but also the user can rotate his wrist as necessarily occurs during the normal upward portion of the swimming stroke, without releasing his grip or position on handgrips 52.

FIGS. 8 and 10 illustrate the cam mechanism used to guide the user's shoulder motions in the proper rotational path with respect to the body centerline. Hollow cylindrical cam 146 is attached to the outside of extension 37 surrounding hole 56. Universal joint 46 rotates inside cam 146, and cam follower 148, mounted on and extending from crank 44, rides on cam surface 150. Cam surface 150 is configured such that on the user's arm downstroke cam follower 148 is urged outwardly, causing crank 44 to pivot on pin 152, forcing the user to keep his or her arms biased inwardly.

The details of the preferred embodiment of the mechanism which provides the simulated water line effect are shown in FIGS. 3, 4*a*, 4*b* and 8. Arm crank 44 is connected through universal joint 46 to shaft 54 which is in turn journaled in holes 56 in the extension 37 of underframe 31 of platform 30. Fixedly mounted on shaft 54 is cam 48. In a first embodiment (see FIG. 4*a*) cam 48 is designed in the approximate shape of a right circular cylinder. One axial half of the cam (designated 48*a*) is a true right circular cylinder with a constant radius. The other axial half of the cam (designated 48*b*) has a radial cross section in which the radii at all points except the end points are less than the radius of the circumscribed circle. The cam 48 may thus be said to be somewhat "flattened" on one side. The cam 48 is mounted on the shaft at the normal center of the right circular cylinder, and is fixed in position as by Allen bolt 58 threaded into threaded hole 60 which extends into cam 48 to a depth past the shaft 54 and is aligned with a mating threaded hole 62 in shaft 54. Hole 60 may extend entirely through cam 48 if desired, but a bottomed hole such as that shown is preferred. Other common means of pinning the cam 48 to the shaft 54, such as an expansion pin or force fit, may also be used.

Wrapping around cam 48 is belt 64. This is normally a coarse-surfaced web belt having a width essentially equal to the cylindrical height of the cam. The web belt 64 does not move but rather presents a fixed frictional surface for the cam to bear against. The frictional forces imposed can be varied by tensioning of the belt 64. This is accomplished by turning bolt 66 which is threaded through a threaded hole 67 in rod 68, to which belt 64 is fixed by screw or rivet 69. As bolt 66 is turned against the fixed end 70 of extension 37 through hole 71, rod 68 is moved horizontally closer to or further away from cam 48, guided by slot 73, thus varying the tension placed on belt 64 and decreasing or increasing the amount of frictional force obtained from the sliding contact between cam 48 and the bearing of belt 64.

Figure 4A:
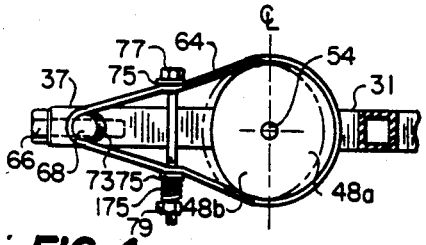
FIGS. 4*a* and 4*b* are side views partially in phantom, illustrating two different cam-and-belt mechanisms used to impart the selective resistance to the user's swimming motion.

The operation of the cam-and-belt mechanism is shown in phantom in FIG. 4*a*. As the user rotates arm cranks 44, each arm crank turns its respective shaft 54 and cam 48. When circular half 48*a* of the cam is aligned to engage belt 64, the user encounters a frictional force simulating the resistance of the water during a swimming stroke. As the cam rotates, the other half 48*b* of the cam passes into the region where, if it were a portion of a right circular cylinder, it would engage the underside of belt 64. Since portion 48*b* is flattened, however, it does not fully engage belt 66 and therefore provides little or no frictional resistance to the user's turning of the arm crank. Thus, as the user rotates his arms through a normal swimming stroke, the cam-and-belt mechanism alternately provides significant resistance and little or nor resistance to the arm movements. By properly aligning the cams 48 on the shafts 54 initially, the frictional engagement of cam portions 48*a* will come when the user's arms are in or below the horizontal plane of the apparatus so that the user properly simulates the motion of his arms through the water and out of the water as found in a normal swimming stroke.

Figure 4B:
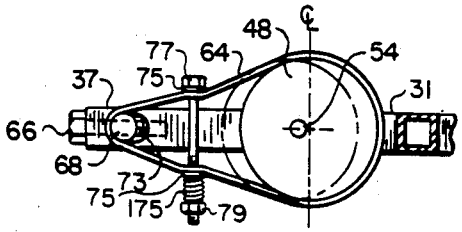

In another embodiment of the cam-and-belt mechanism, the operation of which is illustrated in FIG. 4*b*, the cam is a right circular cylinder but is mounted eccentrically with the shaft 54 passing through the cam 48 at a point slightly offset from but parallel to the axial centerline of the cam 48. As the user rotates his arms, the cam surface is alternately pressed against and retracted from contact with the bearing side of the belt 64. The cam is pinned to the shaft 54 in the manner described above. Again by properly aligning the cam and shaft initially, the frictional resistance occurs when the user's arms are in the lower half of the stroke simulating the resistance of water and the resistance is minimized when the user's arms are on the upper half of the stroke.

If desired the belts 64 can be stabilized by brackets comprising plates 75 on opposite sides of the belt and spring 175 secured through holes in the belt by bolt 77 and nut 79.

The artificial water line effect can be obtained by other means not shown. For instance, meshing friction wheels which have slightly varying radii could be used, so that during half of the wheels' travel they are in tight contact with each other and the turning motion is difficult, while during the other half circle of their travel the engagement is just tight enough to ensure that rotation continues, so that the user needs to exert much less force to turn the wheels. Similarly, meshing gears with alternating tight and loose fits can be used. In another embodiment one could connect the arm cranks to pistons operating within cylinders, such that during one half of the arm travel the user exerts considerable force to move the piston into the cylinder but during the other half of the arm travel the piston is forced outward by hydraulic or pneumatic action and the user's exertion is substantially lessened. In yet another embodiment, the cranks could be attached to weights to be raised over pulleys such that during the resistance half of the stroke the user is exerting himself to raise the weights while during the other half of the arm travel the weights are falling freely back to their bottom position. Other types of arrangements will no doubt suggest themselves to those skilled in the art.

Figure 5:
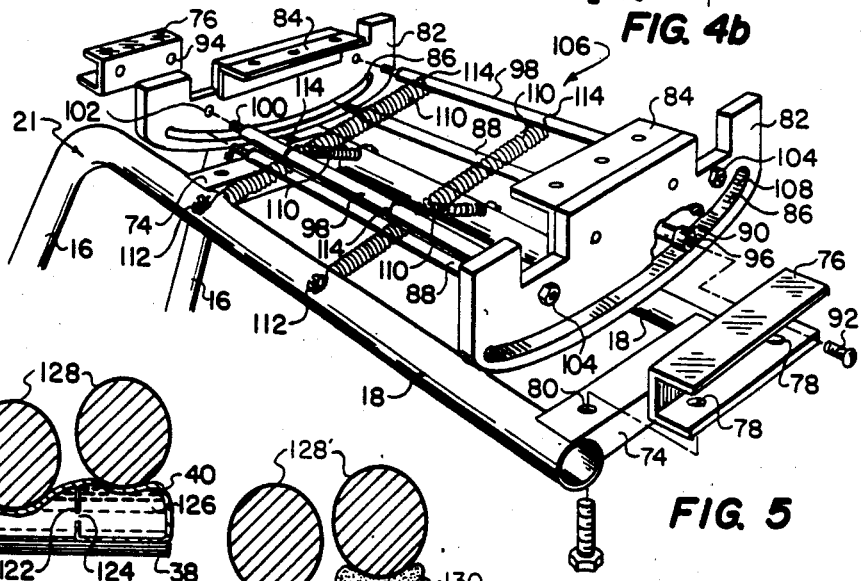
FIG. 5 is an exploded perspective view of a portion of the gimballing mechanism of the present apparatus.

FIG. 5 illustrates one embodiment of the gimballing portion of the apparatus. Frame members 16 and 18 are shown on which the apparatus rests. Cross pieces 74 serve both as spacers and stiffeners for the frame and also as supports upon which the gimballing apparatus 106 is mounted, and through which in turn the platform 30 is attached to the frame 12. Mounted on cross pieces 74 are brackets 76 which are attached by bolts (not shown) through holes 78 and 80. Mounted on the bottom of the platform 30 are guide plates 82. The guide plates 82 are attached to the under side of platform 30 through angle irons 84 which may be bolted or welded to the guide plates 82. Each guide plate 82 has cut therein a curved opening 86 which is basically an arc of a large radius circle or a portion of an elongated ellipse. The opening 86 is sized to accept bearings 90 which are rotatably mounted on the ends of shafts 88. The shafts 88 are secured to the brackets 76 by bolts 92 passing through holes 94 in the brackets threaded into the internally threaded openings 96 on the ends of shafts 88. The rockers 82 are spaced apart at a predetermined dimension by spacer rods 98 which are secured to rockers 82 by studs 100 passing through holes 102 and secured by nuts 104.

When the user is lying on the apparatus and performing the swimming motions, the gimballing apparatus 106 allows the platform 30 and extension 38 to rock generally along the user's axis. The rocking usually is to approximately 10° to 20° to each side of the center line of the apparatus. The degree of rocking is controlled by the degree of curvature and length of the openings 86. The openings are normally sized so that bearings 90 turn freely within the openings and run easily along the upper surfaces 108 of the openings. If desired, however, the rocking can be impeded or even halted entirely by blocking or restricting the travel of bearings 90 in openings 86. The return motion of the gimbals is aided by tension springs 110 which are secured at opposite ends to the frames 18 by screws 112 and to the spacer rods 98 by hooks 114. This arrangement causes the springs to resist the rocking motion and to bias the gimballing apparatus 106 to return to a neutral center position aligned with the centerline of the apparatus. The resistance to rocking obtained with the springs and the rapidity of return to the neutral position can be regulated by choice of spring length and stiffness.

Alternatively, the gimballing device can be biased to return to neutral by use of piston and cylinder arrangements which replace the springs. The device in rocking would then compress or extend pistons and the hydraulic or pneumatic reaction of the cylinder would tend to restrict the degree of rocking and bias the gimballing device back to its neutral position. Other arrangements, such as pulley-and-spring mechanisms and counterbalances will also be apparent to those skilled in the art.

The gimballing motion is aided and smoothed by the presence of counterweight 116. Counterweight 116 comprises an extended shaft 118 which is secured at its upper end to the under side of platform 30 (or extension 38) and has provision to support weights 120. Typically, this provision consists of a fixed plate 122 at the end of shaft 118 and utilizes sloted weights 120 of the type commonly used in wall mounted weight and pulley exercise devices. Alternatively, weights 120 can be flat plates with center holes which are slipped over shaft 118 and the entire weight assembly secured with a clamp or other securing device (not shown) fixed onto the end of shaft 118. The counterweight has a flywheel effect which both restrains and smoothes the gimballing motion. The degree of this effect will, of course, be determined by the amount of weight present in the counterweight as well as by the effective length of the shaft 118. The effective length of shaft 118 can be changed without altering the shaft itself by having the securing device positioned at a point on shaft 118 inward of the shaft end. This moves the weights 120 closer to the underside of platform 30 and varies the counterbalancing effect of the mechanism accordingly.

Alternatively, the flywheel effect can be obtained by means of devices such as pistons and cylinders of spring loaded devices, particularly those having adjustments to vary the spring tension.

Figure 6:
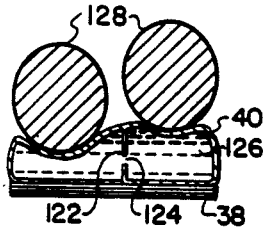
FIG. 6 is a schematic cross sectional view illustrating one form of the leg exercise portion of the present apparatus.
Figure 7:
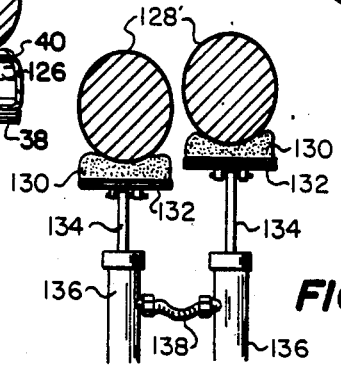
FIG. 7 is a cross sectional view showing another embodiment of the leg exercise portion of the present apparatus.

The gimballing effect (particularly as aided by the flywheel effect) captures the normal translation that the body goes through in swimming. Such motion can be readily observed in underwater films of normal swimming strokes. FIGS. 6 and 7 illustrate alternative means of providing resistance to leg motion as the user simulates the common flutter kick. In FIG. 6 a cross section is shown of the extension 38 and fluid-filled bag 40. The bag 40 is one piece but contains internal baffles to restrict the flow of fluid from one side to the other. A typical baffle 122 with a restricted opening 124 is shown in FIG. 6. The fluid 126 essentially fills the bag 40, but the volume of fluid is controlled so that the user can cause the bag 40 to flex as he alternatively moves his legs (which are shown schematically in cross section as 128). This allows for normal average thigh travel as shown by underwater film studies.

It will be noted that, unlike many of the prior art devices, the extension 38 and bag 40 are one piece, rather than being split into two distinct leg portions. This is the preferred embodiment of the present device. It is known that while most of the motions involved in swimming are beneficial to the swimmer, significant upward leg motions and undue downward resistance can put undue stresses on the swimmer's lower back and spine, due to the lever arm effect that the legs have at their pivotal point at the hips. These stresses are minimized by preventing excessive alternating leg motion, which is accomplished in the present device by the one piece construction of the extension 38 and the bag 40.

In a different embodiment shown in FIG. 7, the user's legs 128 alternately press against pads 130 which are attached to plates 132 and pistons 134. The pistons 134 operate in cylinders 136 which are interconnected by hose 138 which allows a certain amount of fluid interchange between the two pistons, thus acting essentially as the baffle 122 and openings 124 and bag 140. While in this embodiment the two legs do work against separate resistance devices and could thus be considered to be "split" the resistance of the pistons and cylinders is adjusted such that the undue degree of leg motion is avoided.

In yet another embodiment, the user's thighs could rest on a small board-like support which is pivoted along its center line parallel to the axis of the apparatus. A downward thrust with one leg would then elevate the opposite leg in the manner of a child's seesaw. The degree of resistance provided could be adjusted by having tension or compression springs under the ends of the support or by having a torque spring associated with the pivot mechanism.

It will be evident that a large number of accessory devices can be attached to the present apparatus which will assist the user in measuring, observing and recording the progress of his exercise program. For instance, a lap counter could be attached to the arm cranks by suitable gearing or electronic means, such that the distance the user would have traveled while actually swimming in water with the same number of arm strokes can be measured, displayed and recorded. Measurements could be displayed in the form of number of laps theoretically swum in a pool of given length or could be displayed as yards, meters or miles which would have been swum. Of course, the swimmer's average speed can be also be calculated readily.

A heart rate monitor could also be incorporated into the device which allows the user to constantly monitor his heart rate as he exercised.

One could also include a metronome or pacer which the user could preset to allow him to maintain a desired swimming pace.

The unit can also be made readily foldable and/or disassemblable for easy transport by putting suitable joints in the frame 12. Such joints would have locking devices so that when the frame was assembled or unfolded and opened, it would be held rigidly in place to provide a safe exercise apparatus for the user.

In addition to use as an exercising device, the apparatus of the present invention can be used as a training device for speed swimming, water polo conditioning and the like.

It is also possible that the apparatus of this invention may find use as a therapeutic device in medical programs for patients who have muscular, arthritic, spinal or similar problems, in programs where physicians would commonly prescribe swimming as a therapeutic activity.

It will be understood that the above description and drawings are for illustration and example only, and that there are numerous other embodiments of the apparatus not shown which are clearly within the scope and spirit of the invention. Consequently, the scope of the invention is to be limited solely by the appended claims.

We claim:

1. Apparatus to enable a user to simulate the beneficial motions of swimming, which comprises:

a. a platform to support the user's trunk in a generally horizontal position;

b. means which supports said platform and extends downwardly therefrom to the floor upon which the apparatus rests, to elevate said platform to a level above said floor at which said floor will not interfere with the user's movements while using said apparatus;

c. a pair of arm cranks, one mounted on either side of the axial centerline of said platform, each arm crank having means permitting motion in three dimensions, which when grasped by the user allow the user's arms to be moved normally through the full arm rotation movements of swimming;

d. selective resistance means operably attached to each of said arm cranks to provide significant resistance to the user's rotational movements of each arm only when the arm is at or below the horizontal plane of the user's trunk and to eliminate said resistance when the arm is above siad plane; and e. support means attached to the inferior end of said platform to support the user's thighs and to permit limited motion of said thighs in a flutter kick movement.

2. Apparatus as in claim 1 wherein the swimming stroke simulated is the crawl or butterfly stroke.

3. Apparatus as in claim 1 wherein each said selective resistance means comprises a cam rotatable with said arm crank, which cam bears on a frictional surface while said arm crank is at or below said plane and does not significantly bear on said surface while said crank is above said plane.

4. Apparatus as in claim 3 wherein said cam has the shape generally of a right circular cylinder but wherein one hemicylinder has radii less than the circular radius.

5. Apparatus as in claim 4 wherein said cam has the shape of a right circular cylinder and rotates eccentrically about the rotational axis of said arm crank.

6. Apparatus as in claim 4 wherein said frictional surface comprises an elongated web which wraps around a portion of the radial surface of said cam.

7. Apparatus as in claim 1 further comprising gimballing means attached to said platform to permit limited axial rotational motion of the user's trunk in response to the user's arm motions.

8. Apparatus as in claim 7 wherein said gimballing means comprises an undercarriage having at the axial ends thereof bearing guides extending downwardly from said platform, each guide having therein a curved slot; rod means mounted on said frame and projecting through said slots; and spring means connecting said undercarriage to said frame such that the rolling motion of said platform is guided by the cooperation of said rods in said slots and limited in extent by the restraining force of said springs.

9. Apparatus as in claim 1 wherein said support means comprises a fluid filled flexible container having an upper surface upon which the user's thighs rest and further having a longitudinal interior baffle limiting flow of fluid from one interior portion of said container to the other portion.

10. Apparatus as in claim 1 wherein said support means comprises a pair of pistons and cylinders with a restricted fluid connection therebetween, with each piston having thigh support means mounted on the top thereof.

11. Apparatus as in claim 1 wherein said arm cranks contain telescoping portions such that the user's arm extension may vary as the user's arms are rotated through a simulated swimming stroke.

12. Apparatus as in claim 11 wherein said arm cranks terminate in a handgrip comprising a contacting surface for the user's hand on a member which member is rotatably mounted on a shaft, said shaft being connected through a universal joint to a sleeve slidably fitted on the outer of the said telescoping portions of said arm cranks such that during the user's arm stroke the user's wrist may move through the conventional rotational motions associated with swimming.

13. Apparatus as in claim 1 further comprising a counter attached to said arm cranks to indicate the equivalent distance the user would have traveled if actually swimming in a body of water.

14. Apparatus as in claim 1 further comprising means to secure the user's trunk to said platform.

* * * * *